US007373677B2

(12) United States Patent
Barthelt

(10) Patent No.: US 7,373,677 B2
(45) Date of Patent: May 20, 2008

(54) ROTARY BED COMPRISING AN IMPROVED ROTARY HINGE

(76) Inventor: Hans-Peter Barthelt, Hegens-berger Str. 132, Esslingen (DE) 73732

( * ) Notice: Subject to any disclaimer, the term of this patent is extended or adjusted under 35 U.S.C. 154(b) by 44 days.

(21) Appl. No.: 10/532,534

(22) PCT Filed: Oct. 17, 2003

(86) PCT No.: PCT/EP03/11527

§ 371 (c)(1),
(2), (4) Date: Jan. 20, 2006

(87) PCT Pub. No.: WO2004/037147

PCT Pub. Date: May 6, 2004

(65) Prior Publication Data

US 2006/0143828 A1 Jul. 6, 2006

(30) Foreign Application Priority Data

Oct. 25, 2002 (DE) ..... 102 50 075

(51) Int. Cl.
*A61G 7/015* (2006.01)

(52) U.S. Cl. ..... 5/618; 5/612; 5/624; 5/613

(58) Field of Classification Search ..... 5/612, 5/613, 616, 624
See application file for complete search history.

(56) References Cited

U.S. PATENT DOCUMENTS 3,112,500 A * 12/1963 MacDonald ..... 5/618
3,239,853 A * 3/1966 MacDonald ..... 5/616
3,681,792 A * 8/1972 Korber ..... 5/618
5,095,561 A * 3/1992 Green et al. ..... 5/618
5,444,883 A * 8/1995 Iura ..... 5/618
5,497,518 A * 3/1996 Iura ..... 5/618
7,086,103 B2 * 8/2006 Barthelt ..... 5/613

FOREIGN PATENT DOCUMENTS

| | | |
|---|---|---|
| DE | 3737411 A1 | 5/1989 |
| DE | 4422850 A1 | 1/1996 |
| DE | 19854136 A1 | 6/1999 |
| DE | 19912937 A1 | 9/2000 |
| EP | 0596115 A1 | 5/1994 |
| GB | 2223936 A | 4/1990 |

* cited by examiner

*Primary Examiner*—Michael Trettel
(74) *Attorney, Agent, or Firm*—Leydig, Voit & Mayer, Ltd.

(57) ABSTRACT

A nursing bed is provided that has a height adjustable base, in which a rotary hinge is attached in a substantially countersunk arrangement. The rotary hinge connects the base to an intermediate frame on which the actual reclining frame is installed. In this way, a bed framework is obtained, which, after subtracting the height of support feet, has a very small structural height, so that in the lowest position, the distance from top edge of the mattress from the floor corresponds to the length of a lower leg, while simultaneously there is still space underneath the base.

49 Claims, 12 Drawing Sheets

ROTARY BED COMPRISING AN IMPROVED ROTARY HINGE

FIELD OF INVENTION

The present invention generally relates to a rotary bed such as used in nursing applications.

BACKGROUND OF THE INVENTION

From practice, a rotary bed is known, in which a reclining frame is arranged on a height adjustable base. The reclining frame is connected to the base by means of a rotary hinge. The reclining frame is essentially separated into three sections: a back section, a central section, and a leg section. The leg section is divided into a proximal and a distal lower section.

With the aid of electromotive drive devices, the reclining frame can be converted from a more or less elongated reclining or bed position into a seat position. For this purpose, the reclining frame is brought 90° from the reclining position into a position perpendicular to the base with the aid of the rotary hinge. The back section of the reclining frame is raised while the distal lower section of the leg section is lowered downward. The central section and also the proximal leg lower section form a sitting surface for the patient.

The distance of the upper edge of the sitting surface to the floor (increased by the thickness of the mattress, if necessary) corresponds to human anatomical proportions. This means that the distance may not be greater than the distance from the back of the knee to the floor, because otherwise the feet of a patient sitting on the bed would not contact the floor. This would thereby make standing up more difficult.

In these known beds, the rotary hinge comprises a circular ring made from an L shaped angle profile arranged on the head of the base. Underneath the circular ring runs a bracing cross, which contacts a bearing socket aligned vertically at the interface of the braces. A rotary peg, which is connected to a frame of the rotary hinge, is seated in this bearing socket so that it can rotate. The frame of the rotary hinge comprises spars, which are arranged along the edges of a square, where the edge length corresponds to the diameter of the circular ring. In the middle of the longitudinal spars, rollers are supported, which run on the top side of the circular ring. The spars of the intermediate section of the reclining frame are rigidly connected to the square frame of the rotary hinge by means of posts. When a load is applied to the reclining frame, the rollers take up the compression forces, while the tensile forces are introduced into the base via the axial peg and the socket.

The structural height of the rotary hinge is relatively great, which requires that the base contact the floor directly without any free clearance. The base cannot be further compacted for two different reasons: the braces forming the base have certain minimum cross sections, so that they are able to receive forces without causing deformation when a load is applied to the bed. At any rate, the bed must be dimensioned for a patient weight of approximately. 180 kg. The other initial condition preventing the base from being further compacted is the applied forces on the drive device. The more the base is compacted, the shorter the lever arms on the individual crank levers, with the aid of which the base is elongated by the drive device.

Further increase of the structural height in the known rotary bed construction is produced from the fact that spacing, in which the drive devices for the leg section and the back section are to be accommodated, must be provided between the reclining frame and the frame of the rotary hinge. The required drives are located above the frame of the rotary hinge because its interior is likewise filled with a bracing cross for holding the axial peg.

These issues prevent the base from being set on feet in the known rotary bed; instead the bed must directly contact the floor with the lower spars or braces. However, such an arrangement is unfavorable ergonomically since care personnel must maintain a spacing corresponding to the size of their feet from the reclining frame. At best, the care personnel can place their feet directly on the base, which results in a considerable spacing between the lower leg of the care personnel and the edge of the reclining frame. The care personnel cannot be supported with the lower leg or knee against the edge of the bed when caring for the patient in the bed, so that ergonomically unfavorable proportions are created.

BRIEF SUMMARY OF THE INVENTION

In view of the foregoing, a general object of the invention is to provide a bed whose base can be raised up, so that a clearance remains underneath the base so as to enable care personnel to step closer to the bed.

According to the invention, a rotary hinge can be provided that has a supporting ring, within which the swiveling bolster is located and to which the reclining frame is directly or indirectly attached. The swiveling bolster is connected exclusively via the supporting ring to the base, whereby no center axial peg is required. Therefore, the area within the swiveling bolster is free. This clearance enables the accommodation of parts of the drive devices for the back and the foot sections of the reclining frame, which is advantageous for reducing the structural height.

The swiveling bolster of the rotary hinge is located within the supporting ring thereby also reducing the vertical extension of the rotary hinge compared with a sandwiched construction, in which the swiveling bolster is arranged exclusively above the supporting ring, as is the case in the prior art.

Preferably, the swiveling bolster is assembled from two parallel spars, which run in the longitudinal direction parallel to each other and which are rigidly connected to each other via cross braces. The cross braces are screwed together, which simultaneously enable a setting of the width of the longitudinal spars. In this way, manufacturing tolerances can be equalized without additional mechanisms. In addition, the screwing of the braces to each other enables simple assembly of the swiveling bolster within the supporting ring.

Preferably, the supporting ring has a U shaped profile, so that the bearings, which connect the swiveling bolster to the supporting ring, can engage in the U profile. This can also contribute to a reduction of the structural height. Otherwise, for a disk shaped supporting ring, the bearings must be attached to both sides of the supporting ring, in order to also be able to transfer the cross forces, i.e. the tensile forces, directed upward to the ring without axial pegs.

The bearings preferably each comprise an axle connected to the end of the corresponding spar and a roller running on this axle. With the aid of the roller, the axial forces, i.e. the forces acting both downward and also upward, can be transferred. Such forces acting upward are produced, e.g., when the foot end of the reclining frame is more strongly loaded than the head end or when the reclining frame is located in the seat position, because then the sitting surface is predominantly in front of the vertical rotational axis of the rotary hinge due to anatomical reasons.

So that the swiveling bolster runs easily within the supporting ring, rollers supported in the radial direction are advantageously present on the supporting ring. The rollers are used to center the swiveling bolster in the supporting ring, which conventional cylindrical support rollers taking on the axial forces are not able to perform.

According to a different embodiment of the rotary hinge, a circular arc is used as the supporting ring, whose arc length is smaller than 360°. For this rotary hinge, an axial peg is also provided, that is located directly next to one side of the head of the base. Therefore, the interior remains free for the most part, so that space is created to accommodate the drive devices for the reclining frame. Incidentally, the setup can be configured essentially exactly as in the embodiment of the invention explained above.

The advantage of the second embodiment is that in the seat position, the side of the reclining frame adjacent to the head end is not moved as much in the direction toward the head end. This side remains essentially at the height of the rotational axis since the rotational axis is directly adjacent to the relevant side of the reclining frame.

In contrast, in the first embodiment, the relevant side of the reclining frame moves closer to the head end by the distance that the side has from the vertical rotational axis. As a result, in the seat position, the clearance between the reclining frame and the head end of the bed becomes significantly smaller. In addition, the second embodiment with the open supporting ring permits the use of extra wide reclining frames.

As already mentioned several times, the reclining frame is divided into several sections that can move relative to the central section. In this way, in combination with other rigid parts of the bed, dangerous pinching and cutting points can be created. Even when these are allowable according to the appropriate standard and safety regulations, because they have been viewed as unavoidable until now, it is advantageous when a new construction eliminates these pinching and cutting points. This is even more advantageous especially when the structural height is not unfavorably affected.

According to another aspect of the invention, an intermediate frame is used between the reclining frame and the rotary hinge that is significantly narrower than the width of the reclining frame. In this way a distance corresponding to the height of the spars of the intermediate frame is absolutely enforced between the reclining frame and the top side of the base. This distance is large enough that injury to a person is precluded due to the strength requirements for the spars and their resulting dimensions.

In addition, in the clearance profile of the intermediate frame viewed in the horizontal direction, parts of the drive devices for the rear section and the foot section of the reclining frame can also be accommodated. Thus, it is possible to accommodate in the area between the two longitudinal spars of the intermediate frame a longitudinal guide device, within which a sled is guided. On one side of the sled a drive device is attached. On the other side, a kind of connecting rod that transfers the movements of the sled to the foot section of the reclining frame is attached. In this way, as compared to the prior art, the structural height saved is quite large. The drive device in such known beds typically comprises an electric motor with a screw spindle drive. If this screw spindle drive were attached directly to the foot section as in the prior art, it would have to complete a considerable swinging motion. The distance between the upper edge of the base, or the rotary hinge and the bottom side of the reclining frame must be selected correspondingly large in the prior art. The present invention decreases the swinging motion of the drive device and reduces the connecting rod, which requires significantly less space in the vertical direction. In addition, the space within which the swinging motion occurs can be shifted into areas in which sufficient space is available, also without increasing the vertical structural height.

Dividing the reclining frame into several sections moving relative to each other requires that all of the forces originating from the weight of the patient be transferred to the base merely via the intermediate section. Thus, the specific loading in the area of the intermediate section is extremely high. In this area, the bed construction must be stable and stiff, so that any elastic deformation is for the most part prevented, which under some circumstances could lead to parts of the bed being allowed to collide with each other during the rotational motion.

The stability can be significantly increased if the spars of the intermediate frame are reinforced relative to each other by two essentially rigid braces. These two braces are located in vertical planes spaced apart from each other approximately at the height, relative to the longitudinal extent of the bed, at which the spars of the intermediate section of the reclining frame are connected to the intermediate frame. In this way, a box type construction is produced that is very stiff relative to the occurring forces. Here, it is also possible without additional elements to use a construction, in which (as explained above) a connecting rod is driven with the aid of the drive device for moving the foot section.

As a result of the low structural height of the rotary hinge or of the distance of the bottom side of the reclining frame from the head of the base, the arrangement with shaft and levers known from the prior art cannot be used for moving the back section. The shaft can no longer be driven. Therefore, in the design according to the invention, a drive device is used that attaches directly to the back section. The back section and the force axis, along which the drive device acts against the back section, form an acute angle, wherein the drive device supports itself in the intermediate frame or on the reclining frame. Therefore, considerable tensile forces are induced in the hinges that connect the longitudinal spars of the divided sections to each other. The tensile forces generated there are significantly greater than the forces occurring when the back part is raised by means of levers that are attached to a separately supported shaft, as in the prior art. Therefore, considerably more rigid hinges are required to connect the longitudinal spars of the sections of the reclining surface to each other.

With the present invention, brackets are provided, which run in the longitudinal direction of the corresponding spar and which form the hinge brackets. Between every two brackets forming a hinge, at least one circular disk shaped spacing element is arranged. The spacing element is preferably greater in diameter than the vertical extent of the corresponding longitudinal spar. Thus in each pivoting position of the spars relative to each other, pinching and clamping positions are effectively prevented.

In the simplest cases, the brackets can be one piece components of the spars. The spars are preferably quadrilateral pipes with an approximately rectangular recess or notch provided on the ends. Therefore, brackets with a U shaped cross sectional profile are produced in the extension of the complete cross section of the spaces. The back of the U shaped profile represents the extension of the outer lying wall of the spar, while the lateral bars or legs of the U shaped cross sectional profile are formed by wall sections of the original pipe cross section. In this way, the brackets formed are very resistant to bending in the direction perpendicular to the back of the bracket relative to the rest of the spar.

DETAILED DESCRIPTION OF THE INVENTION

Figure 1:
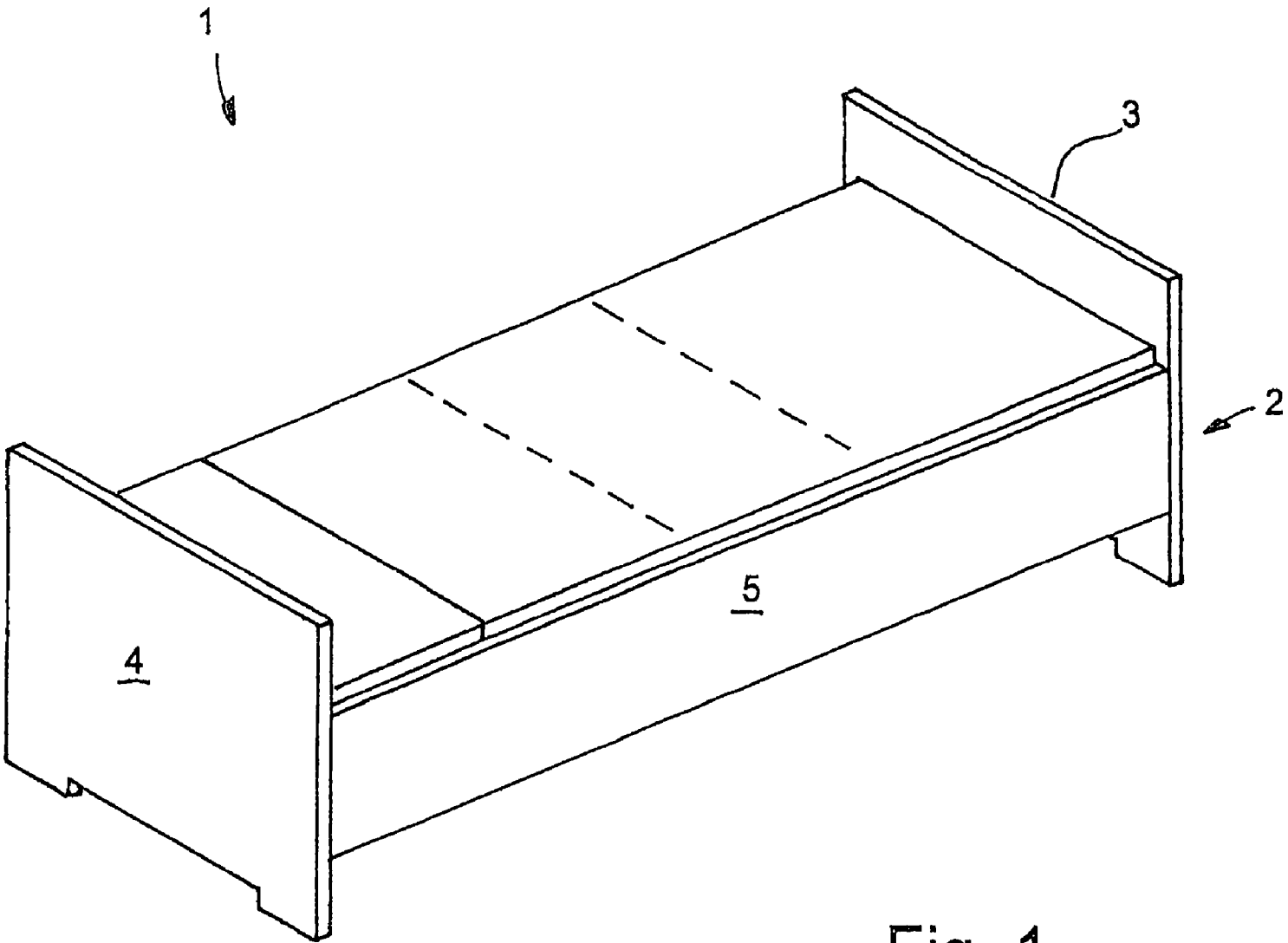
FIG. 1 is a perspective view of an exemplary rotary bed according to the invention in the reclining position.
Figure 2:
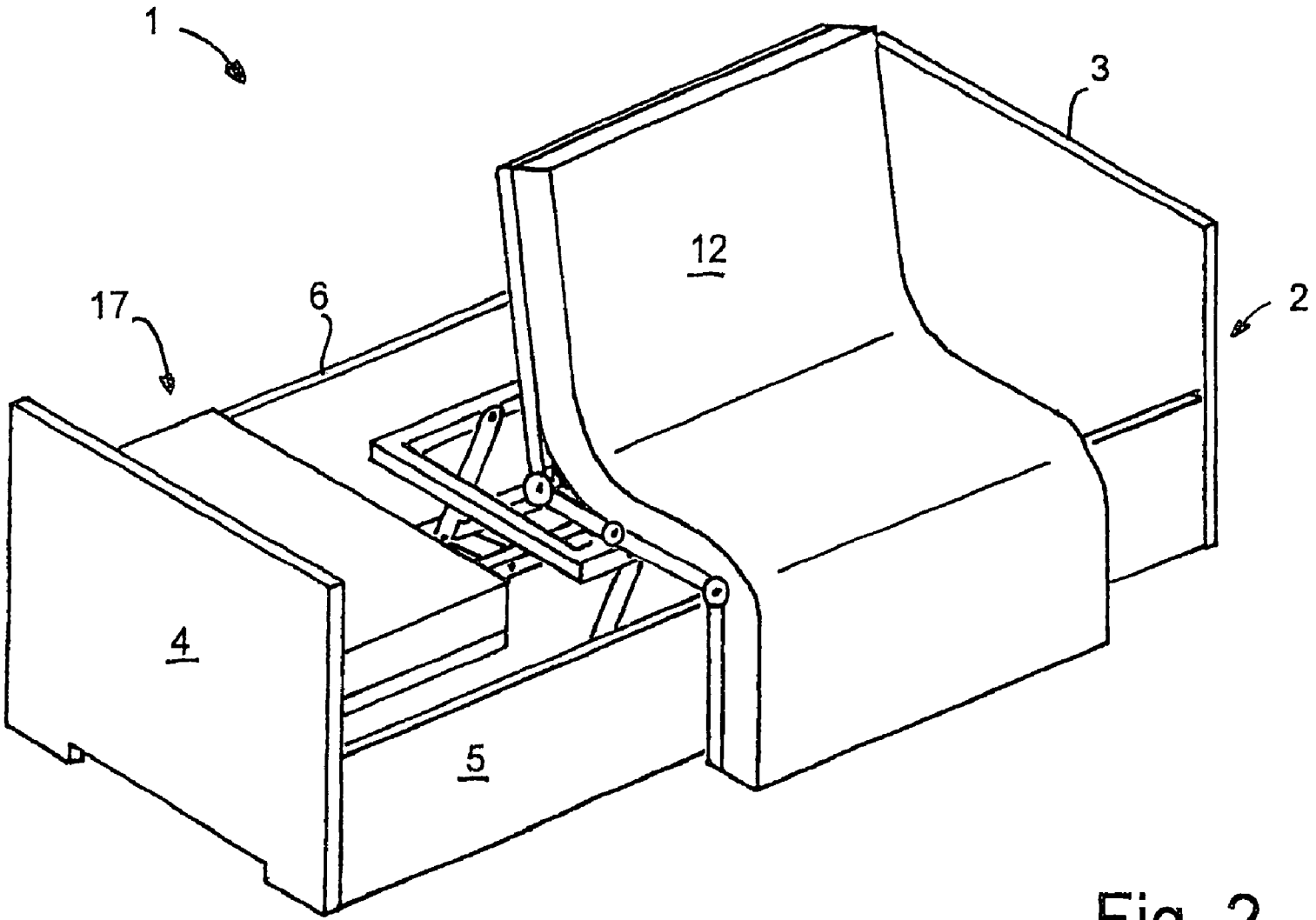
FIG. 2 is a perspective view of the rotary bed of FIG. 1 in the chair or seat position.

FIG. 1 provides a perspective view of a nursing bed 1 in the reclining position, while FIG. 2 illustrates the nursing bed 1 in the sitting or chair position. The nursing bed 1 has a bed border 2 with a head part 3, a foot part, as well as side walls 5 and 6. The proximal side wall 5 with reference to FIGS. 1 and 2 is located in the reclining position as shown at a distance to the floor, whereby there is a gap that enables care personnel to place their toes under the bed, between the lower edge of the side wall 5 and the floor. The side wall 5 is supported so that it can move, and, in the chair position of the nursing bed 1, reach a position shifted downward, as can be recognized from FIG. 2. The special bearing of the side wall 5 is explained in detail, e.g., in DE 199 12 937 A1 the disclosure of which is incorporated herein by reference.

Figure 3:
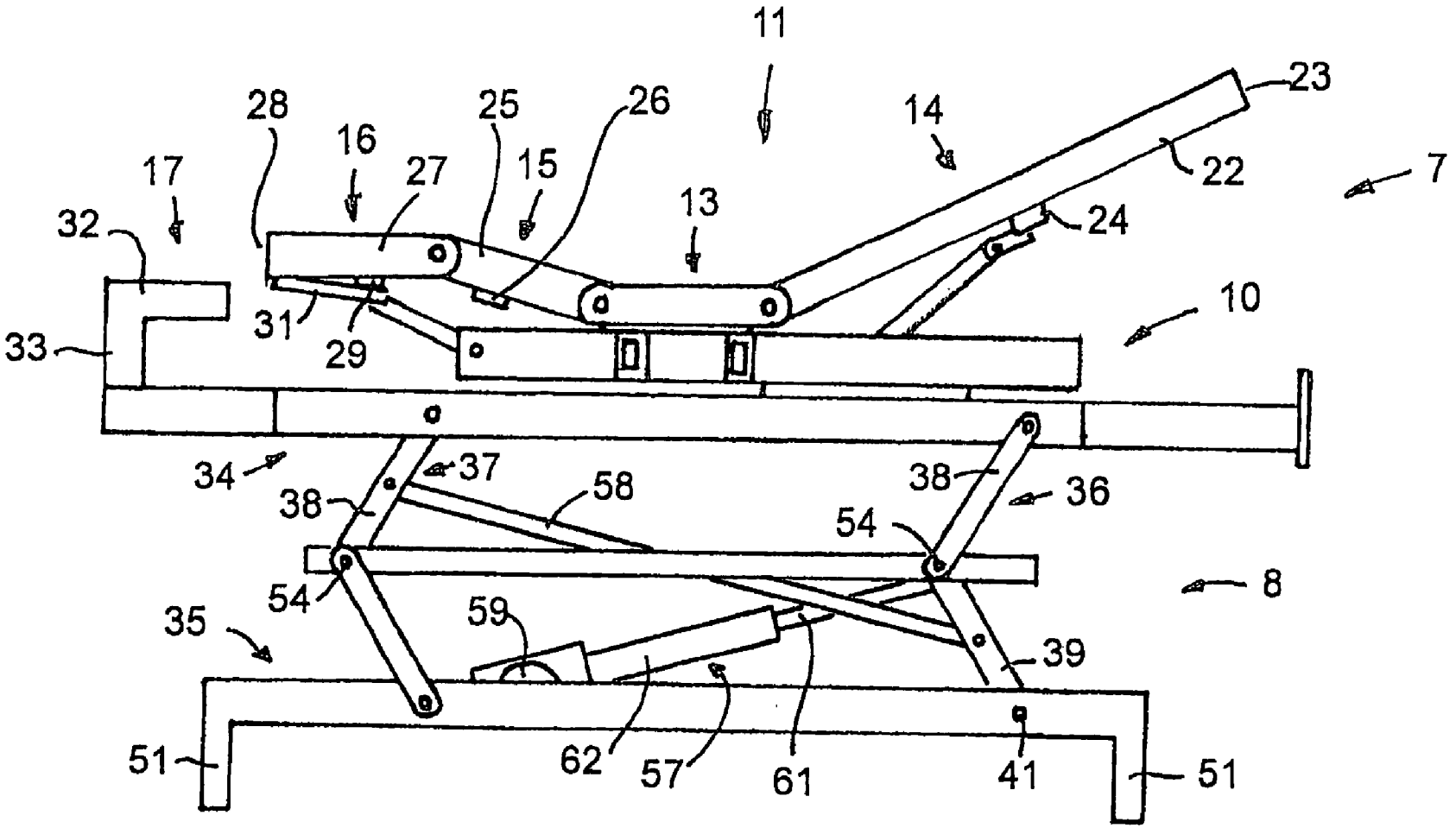
FIG. 3 is a side view of the bed frame for the bed of FIG. 1.
Figure 4:
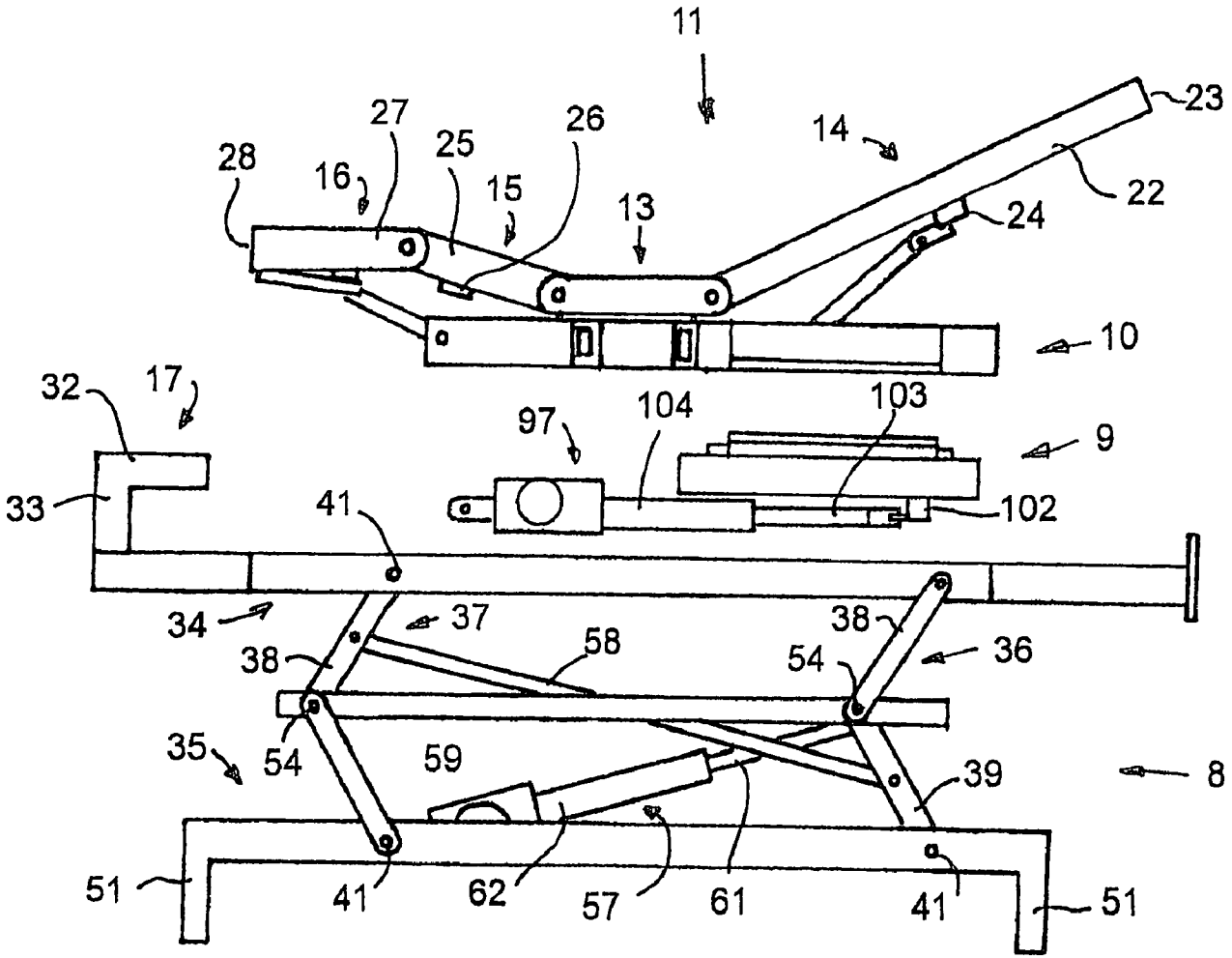
FIG. 4 is a partially exploded side view of the bed frame of FIG. 2.

Within the bed border 2, there is a bed framework 7, as shown in FIGS. 3 and 4. The bed framework 7 includes a height adjustable base 8, on whose upper side a rotary hinge 9 is attached to a vertical rotational axis, an intermediate frame 10, as well as a reclining frame 11, on which a mattress 12 is located. The reclining frame 11 is rectangular in the plan view. The rotary hinge 9 is, for the most part, sunk into the base 8, which can be seen in FIG. 4. Through the countersinking of the rotary hinge 9 in the base 8, considerable savings in structural height are realized.

The reclining frame is separated into a central section 13, which is rigidly connected to the intermediate frame 11, a back section 14, which is hinged to the central section 13, an upper leg section 15, which is likewise hinged to the central section 13, as well as a lower leg section 16. The lower leg section 16 is hinged to the end of the upper leg section 15 at a distance from central section 13. The hinge axes, about which the sections 14, 15, 16 can move relative to the central section 13, lie horizontally. Finally, the reclining frame 12 also includes a foot section 17, which is connected directly and rigidly to the base 8.

Figure 8:
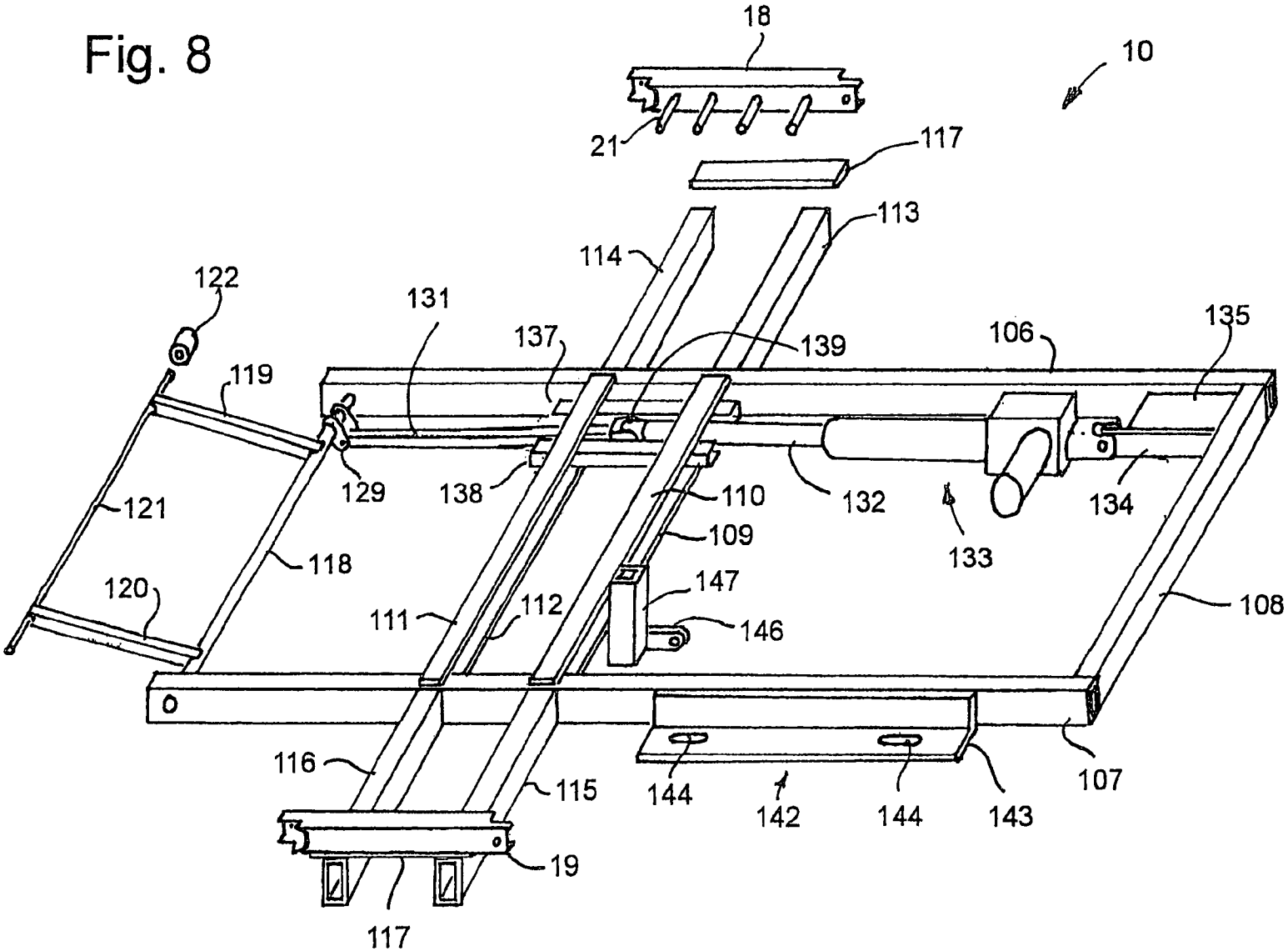
FIG. 8 is a perspective view of the intermediate frame of the bed frame of FIG. 2.

The central section 13 of the reclining frame 12 has two longitudinal spars 18, 19, which run parallel to each other which are shown in FIG. 8. Each of these spars 18, 19 ends at hinge brackets for a hinge, which is explained with reference to FIG. 11. Each spar 18, 19 carries inward-pointing pegs 21 onto which rubber molded pieces are pushed. These pegs hold spring bars in a known way. Instead of spring bars, a plate can also act as a support, as is typical for hospital beds.

The back section 14 is defined by a spar 22, and also another spar, which is parallel to the first spar and which cannot be seen in FIG. 3. The other spar is connected to the longitudinal spar 18, while the visible spar 22 is hinged to the spar 19. The two spars 22 of the back section 14 are connected to each other via a cross spar, at the upper end at 23. In addition, another cross brace 24 runs at the bottom side of the two spars 22.

The upper leg section 15 is also defined by two longitudinal spars, of which only one longitudinal spar 25 can be seen in the drawings. The other longitudinal spar is covered by the longitudinal spar 25. The two longitudinal spars 25 are connected via a cross brace 26. The cross brace 26 runs approximately at the middle of each longitudinal spar 25 on the bottom side.

Finally, the lower leg section 16 is also defined by two longitudinal spars, of which in turn only the longitudinal spar 27 can be seen in the drawings. The two longitudinal spars 27 are connected to each other at the lower end at 28 via a cross brace. In addition to the cross brace 28, the two longitudinal spars 27 are connected by a brace 29, to which two parallel guide rails 31 are attached, which reach to the lower cross frame 28. The guide rails 31 run as shown at an angle to the longitudinal spar 27 such that they converge in the direction toward the foot end. The separation between the two guide rails 31 is significantly smaller than the separation between the two longitudinal spars 27. Relative to these spars, the guide rails 31 are offset inward by approximately 20 cm. The foot section 17 comprises spars 32, which are raised up on the base 8 by braces 33. All of the longitudinal spars 22, 25, and 27 carry pegs corresponding to pegs 21 that point toward the bed center in order to connect to the longitudinal spars 22, 25, 27 with rubber molded pieces between which spring bars extend in a known way.

The height adjustable base 8 includes a top frame 34 and also a bottom frame 35, which are connected to each other by means of a total of five toggle lever pairs 36 and 37. The toggle lever pairs 36, 37 are each located on one longitudinal side of the base 8, so that the corresponding toggle lever pair 36, 37 cannot be seen on the other longitudinal side in the side view in FIG. 4. The toggle lever pair 36, 37 is composed of a top toggle lever 38 and a bottom toggle lever 39. Each toggle lever 38, 39 is connected in an articulated manner by a hinge 41 with a horizontal axis on the relevant bed side to the top or bottom frame 34, 35. All of the axes of the hinges 41 are parallel to each other. The axes of the hinges 41 are coaxial to the axes of the hinges 41 of the toggle lever 38, 39 that cannot be seen.

Figure 5:
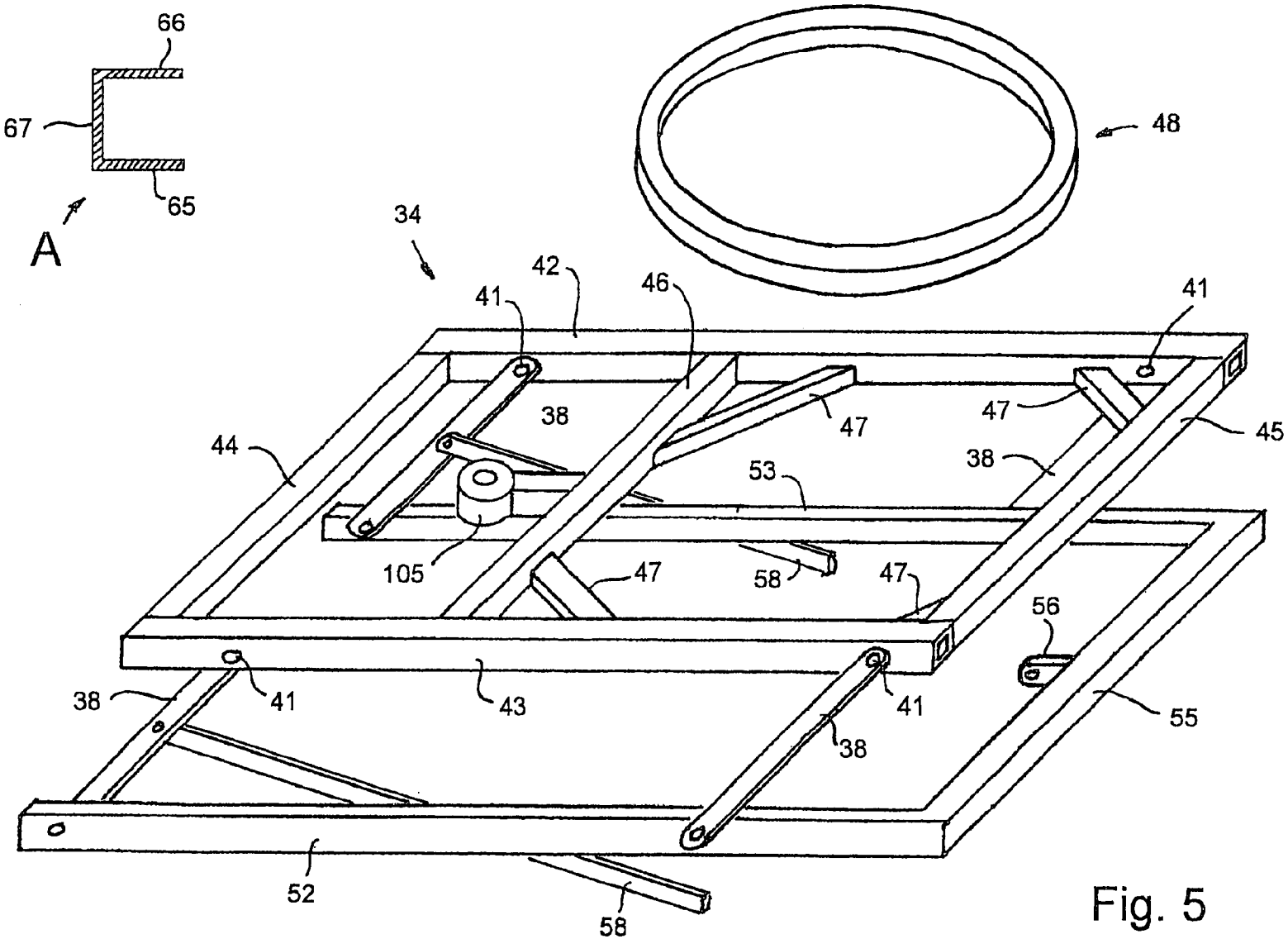
FIG. 5 is an exploded perspective view of the upper portion of the bed frame of FIG. 4.

In detail, FIG. 5 shows the shape of the top frame 34. The top frame includes two longitudinal spars 42 and 43, which are rigidly connected to each other at the ends by cross braces 44 and 45. Another cross brace 46 is inserted, so that, as can be seen in FIG. 5, a quadrilateral hole is produced, wherein in the corners, oblique support braces 47 are welded. The support braces 47 are used as supports for a ring 48 of the rotary hinge 9. The carrying or supporting ring 48 lies on the support braces 47 and is rigidly connected to these braces. With its outer surface, the supporting ring lies on the inner side of the two longitudinal spars 42, 43 or on the inner side of the two cross braces 45 and 46. The two longitudinal spars 42 and 43 contain the boreholes for the top hinges 41, by means of which the top toggle lever 38 is connected in an articulated manner to the top frame 34.

The bottom frame 35 fundamentally has a similar shape as the top frame 34, i.e., it is composed of two spars 49, which run in the longitudinal direction and which are connected to each other by cross braces that cannot be seen in the drawings. The cross braces of the bottom frame 35 are located underneath the cross braces 44 and 45 of the top frame 34. The bottom longitudinal spars 49, which lie parallel to the bed longitudinal direction, are extended as shown over the longitudinal extent of the top frame 34 and provided on the ends with support feet 51. With the aid of the total of four support feet 51 located at the corners of a rectangle, the base 8, and thus the entire bed framework 7, stands on the floor. Through this arrangement a space of approximately 12 cm is created between the bottom frame 35 and the floor, so that care personnel can also place their toes under the base 8. Therefore, the care personnel can assume an ergonomically favorable posture, in that they can step close to the nursing bed 1 so that they can be supported with the lower leg on the bed border 2. In this way, the back muscles and thus the spinal column are significantly less stressed in a bent over posture.

The two toggle lever pairs 36, 37 are coupled to each other by an associated coupling brace 52, 53 on each side of the base 8. Each coupling brace 52, 53 is connected like a hinge, as shown, to the toggle link 54 of each toggle lever pair 36, 37. Finally, the two coupling braces 52 and 53 are connected to each other like a yoke by means of a cross brace 55. A bracket 56 as a counter-support for a drive motor 57 is located at the crossing point 55. Finally, an oblique coupling brace 58 on each side of the base 8 connects the top toggle lever 38 of the toggle lever pair 37 to the bottom toggle lever 39 of the toggle lever pair 36. The kinematics of the base 8 and its dimensioning are explained in detail in DE 198 54 136 A1 the disclosure of which is incorporated herein by reference.

The drive motor 57 is supported at its end at a distance from the bracket 56 on a cross brace, which connects the two longitudinal spars 49 to each other approximately underneath the cross brace 44. The drive motor 57 can comprise a commercially available spindle motor. With the aid of a permanently excited motor 59, a worm gear pair is driven. The worm gear is connected without rotational play to a screw spindle. A threaded nut runs on the screw spindle. The nut is attached to a lifting tube 61, which withstands tensile and compression forces and which runs coaxially in a guide tube 62. The free end of the lifting tube 61 carries a fork head, which is hinged to the bracket 56. Another fork head is located on the opposing end of the motor housing, in which the motor is set in gear with the corresponding direction of rotation.

When the motor is set in gear with the corresponding direction of rotation, the lifting tube 61 is either pulled back into the guide tube 62 or pushed forward out of the guide tube. By shifting the lifting tube 61, the cross brace 55 moves in the direction toward the head end of the bed. In this way, the bottom toggle lever 39 of each of the toggle lever pairs 36 and 37 is raised up, because all of these are connected to each other kinematically via the horizontal coupling braces 52, 53 or the cross brace 55. The raising motion of the bottom toggle lever 39 is transferred via the oblique coupling braces 58 to the top toggle lever 38 of the toggle lever pair 37 set at the foot end. This leads to the result that the toggle lever 38 of the rear toggle lever pair 37 is also raised. This motion is finally transferred also to the front toggle lever pair 36 set at the head end.

Due to the kinematics, it is guaranteed that the top frame 34 always remains parallel to the bottom frame 35. As a result, within the lifting range for which the base 8 is constructed the vertical movement of the top frame 34 results in no significant displacement of the top frame 34 in the longitudinal direction of the nursing bed 1. The resulting longitudinal movement is less than 5 mm.

Figure 6:
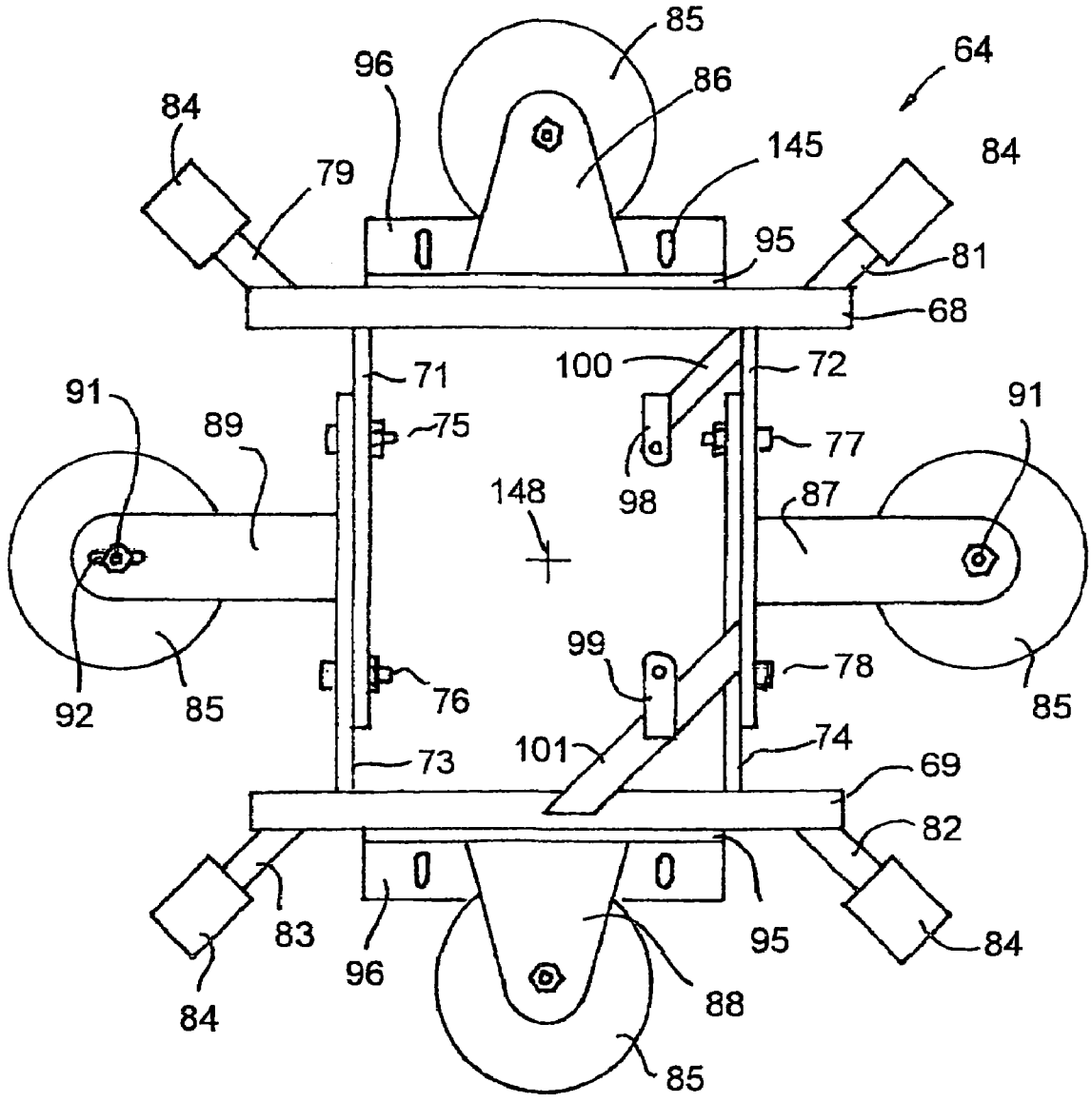
FIG. 6 is a bottom view of the swiveling bolster of the rotary hinge of the bed frame of FIG. 4.
Figure 7:
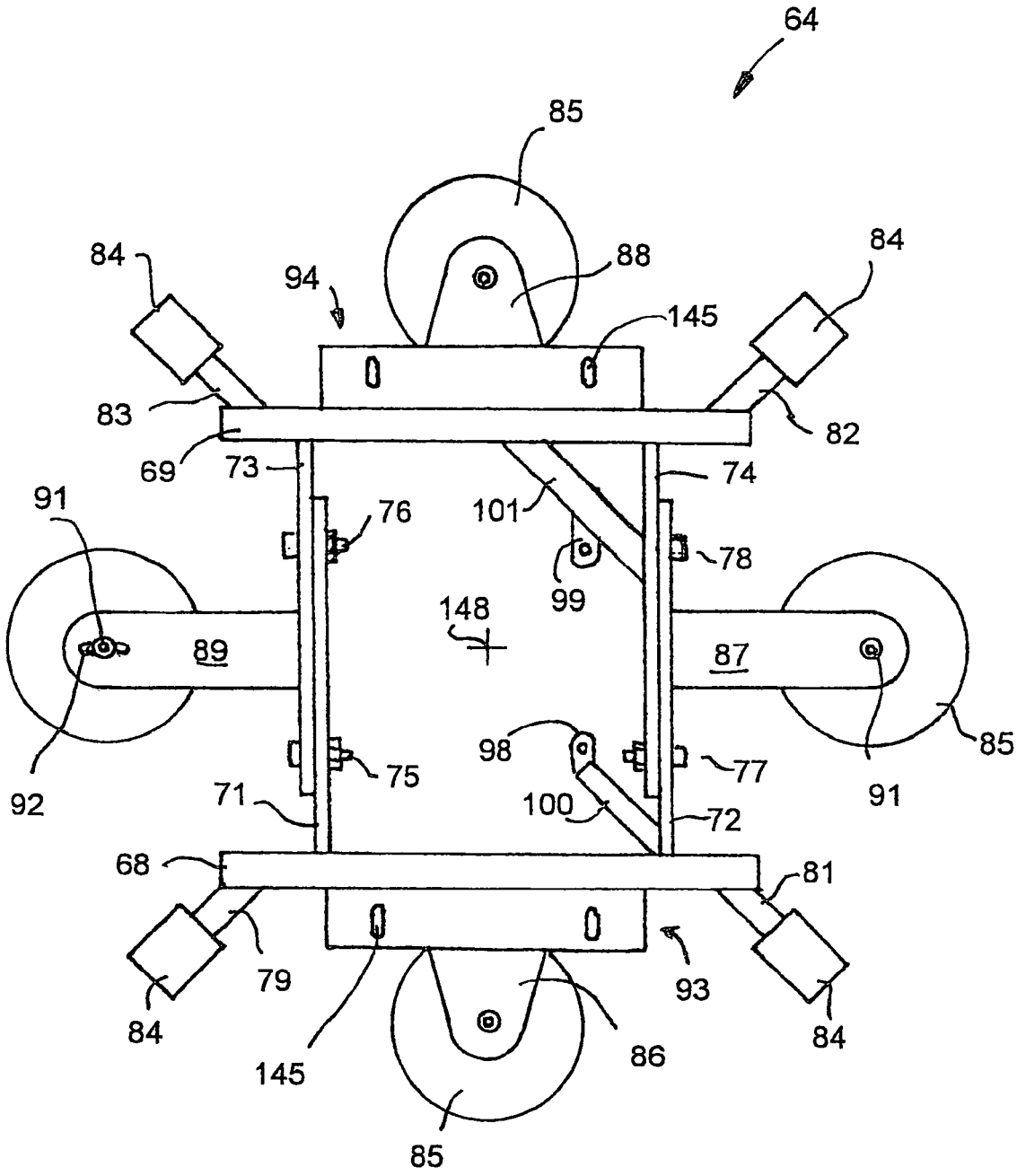
FIG. 7 is a top view of the swiveling bolster of FIG. 6.

The rotary hinge 9 includes the already mentioned ring 48 as well as a swiveling bolster 64 shown from the bottom and top sides in FIGS. 6 and 7, respectively. The ring 48, which is fixed in the top frame 34, has the cross sectional profile shown at A in FIG. 5. The cross sectional profile is U shaped and is composed of a bottom horizontal leg 65, a top leg 66, which runs parallel to the bottom leg 65, and a back 67 perpendicular to these legs. The back 67 forms a cut out of a straight cylindrical surface. The ring 48 is closed, wherein the bottom leg 65 represents a continuous horizontal annular running track.

The swiveling bolster 64 comprises two longitudinal spars 68 and 69. The two longitudinal spars 68 and 69 are parallel to each other. Flat braces 71 and 72, which end at a distance from the opposite longitudinal spar 69 in the assembled state, project on one side from the longitudinal spar 68. The longitudinal spar 69 is provided with corresponding flat rods 73 and 74, which likewise end at a distance from the longitudinal spar 68. The braces 71-74 are fixed to the spars 68 and 69, such that they are congruent in pairs when the spars 69 and 68 are laid one on the other, (i.e., the brace 72 corresponds to the brace 73 and the brace 71 to the brace 74). The contact surface between the braces 71 and 73 has the same extent as the contact surface between the braces 72 and 74 from the adjacent end of the spar 68. Due to this arrangement, the longitudinal spars 68 and 69 form, ideally, the edges of a square, which fits into the ring 68 with a small clearance.

The braces 71-74 are screwed together with a total of four screws 75-78. They pass through corresponding boreholes into the braces 71-74. For the purpose of adjusting to the diameter of the ring 48, some of these openings are elongated holes. Thus, the borehole for the screw 75 in the brace 73 is a cylindrical borehole, while the corresponding opening of the brace 71 is an elongated hole. In the reverse situation, the opening for the screw 76 is a cylindrical borehole, and the corresponding opening in the brace 73 is an elongated hole. The same arrangement applies analogously for the braces 72 and 74.

As shown, axial pegs 79, 82, and 83 are attached to the ends of the longitudinal spars 68 and 69. The axial pegs 79-83 lie in a plane, and their axes intersect in pairs at 90°. The axis of the axial peg 79 is coaxial to the axis of the axial peg 82, while the axis of the axial peg 81 likewise runs coaxially to the axis of the axial peg 83.

A cylindrical running roller 84 sits on each axial peg 79-83. The roller 84 fits between the leg 65 and 66 of the ring 48 with a small clearance when the swiveling bolster is mounted. In this regard, the rollers 84 act as support rollers, which transfer the vertical force between the ring 78 and the swiveling bolster 74. The support rollers 84 can move freely on the axial peg 79 outward in the radial direction. A radial inward shift past the illustrated position is prevented by a contact shoulder, which is formed on each of the axial pegs 59-83.

The radial guide within the ring 48 handles four disk like rollers 85. The rollers 85 stop at the cylindrical surface of the back 67 pointing inward according to the radial loading in the assembled state of the swiveling bolster 64. The rotational axes of the guide rollers 85 are parallel to each other, and they lie, ideally, at the corners of a square, whose diagonal length is smaller than the inner diameter of the ring 48 measured at the inner side of the back 67 by the diameter of the guide rollers 85.

For connecting and holding the guide rollers 85, a total of four bearing blocks 86, 87, 88, and 89 are provided. The bearing blocks are each slotted on the side of the support roller 85, so that two projecting legs are produced, between which the corresponding guide rollers 85 can turn. The bearing block 87 is fixed directly onto the brace 72, and the bearing block 89 is fixed directly onto the brace 73. Both bearing blocks 87 and 89 are located in the middle between the longitudinal spars 68 and 69. The two bearing blocks 86 and 88 are attached on the outer side of the two spars 68 and 69 at the center between the support rollers 84.

The guide rollers 85 turn on axles in the form of spacing sleeves, which are inserted between the forked ends of the bearing blocks 85-89. With the aid of screws 91, they are secured in the bearing blocks 85-89. Only the guide roller 85 sitting in the bearing block 89 can be adjusted in the radial direction for the purpose of radial adjustment of the effective diameter of all four guide rollers 85, wherein in this case only the opening for the screw 91 is an elongated hole 92.

Two angular profiles 93 and 94 are attached to the outer sides of the two longitudinal spars 68 and 69. One of the two legs, the leg 95, is likewise welded tight onto the outer side, while the other leg 96 is flush with the top side of the corresponding longitudinal spar 68, 69. The legs 96 are used as attachment flanges for the intermediate frame 10. The bearing blocks 86 and 88 are welded onto the outer side of the corresponding leg 95.

To couple the swiveling bolster 64 to its associated drive motor 97, two coupling brackets 98 and 99 are provided on the bottom side of the swiveling bolster 64. The bracket 98 sits on an extension arm 100, which is fixed in the inner corner between the brace 72 and the longitudinal brace 78 and projects from there. The other bracket 99 sits on a corner brace 101, which in the illustrated embodiment extends from the longitudinal spar 69 to the connecting brace 74. By means of corresponding spacing pieces 102 (FIG. 4), the two brackets 98 and 99 are offset downward so far that the lifting tube 103 or the guide tube 104 of the drive motor 97 does not touch at any point. The setup of the drive motor 97 is the same as that of the drive motor 57. Therefore further explanation is unnecessary.

When the swiveling bolster pivots, the reaction moment of the drive motor 97 is introduced into a counter-support 105, which is provided on the cross brace 46 of the top frame 34 and thus is located outside of the rotary hinge 9 between the cross brace 46 and the cross brace 44. Depending on which direction of rotation is desired, the lifting tube 103 is selectively coupled to the bracket 98 or the bracket 99.

Figure 9:
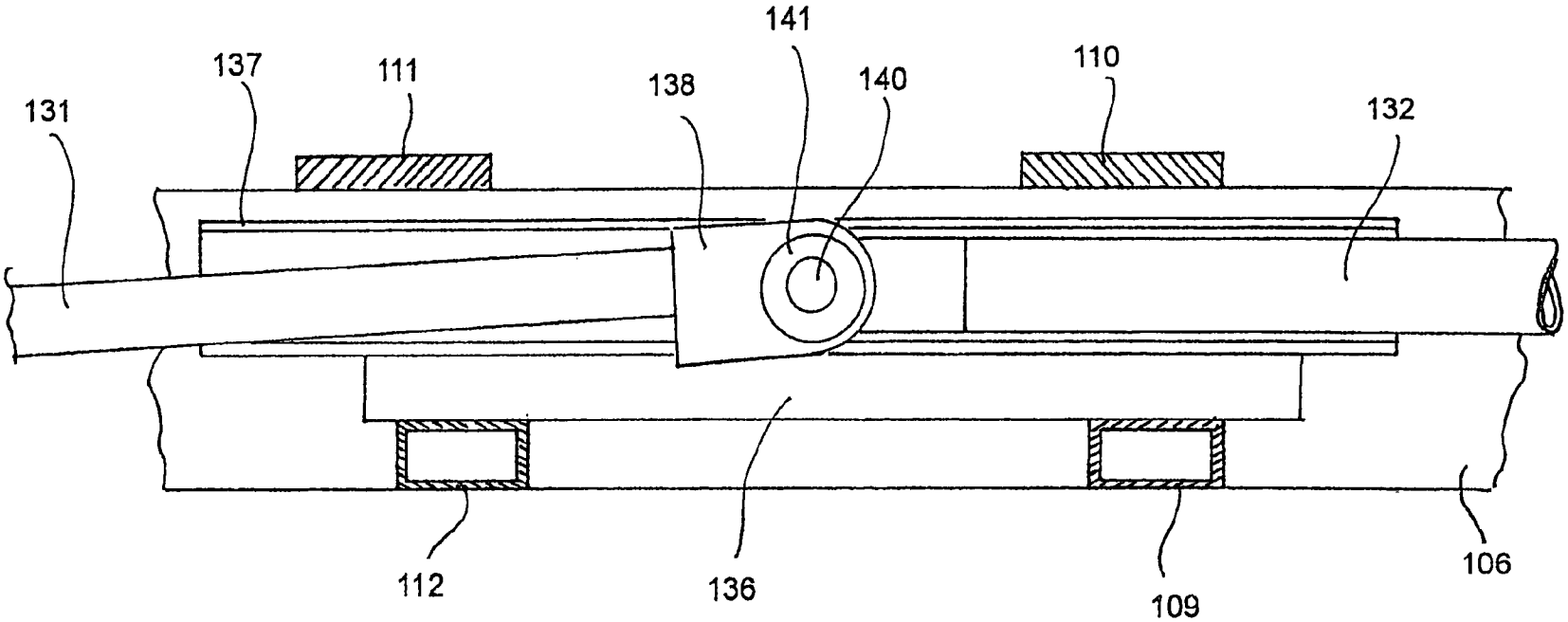
FIG. 9 is an enlarged partial view of the intermediate frame of FIG. 8 showing the bearing of the cardan shaft for the drive of the lower leg section.
Figure 10:
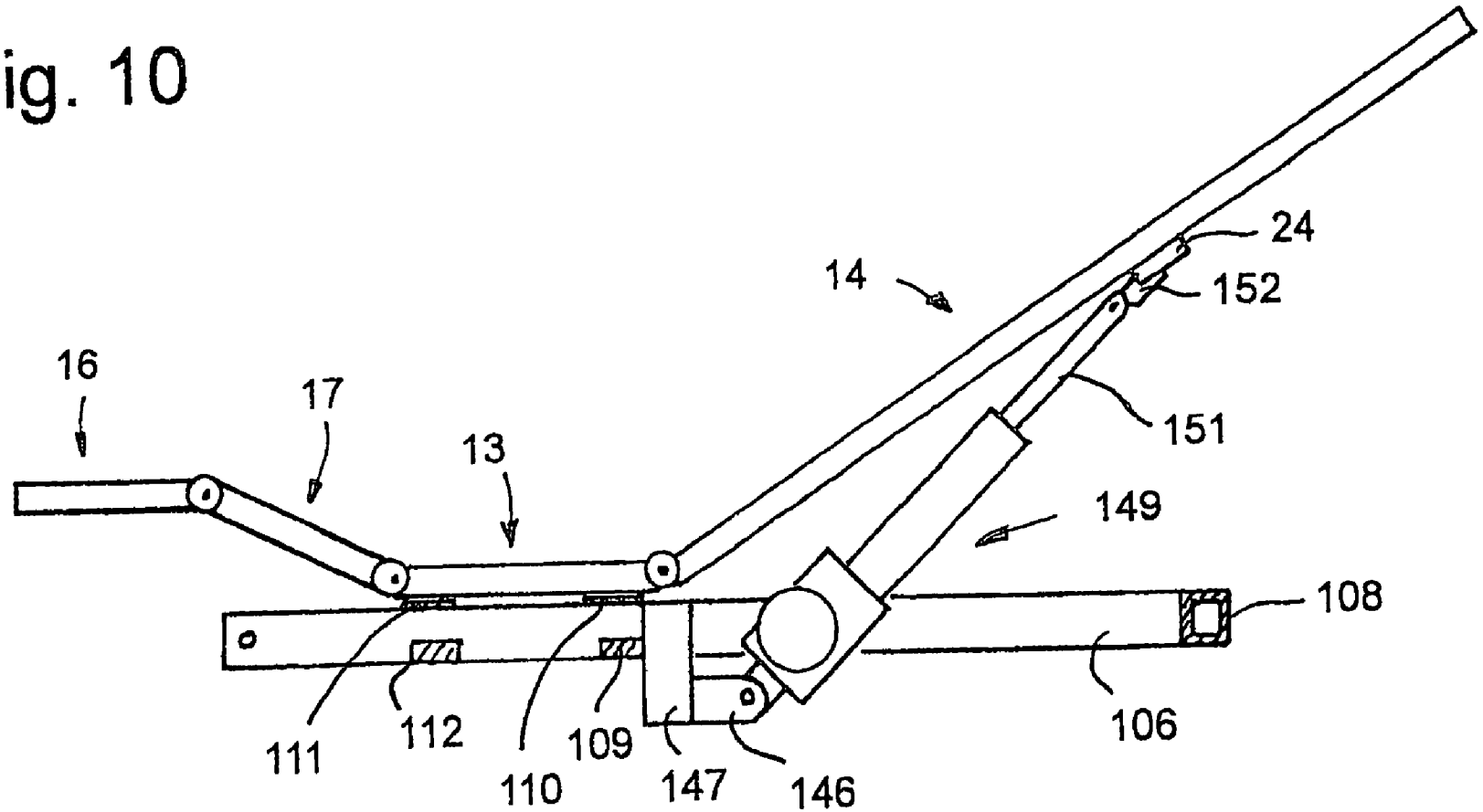
FIG. 10 is a cutaway view of the bed frame from FIG. 2 showing the drive of the back section.

The setup of the intermediate frame 10 is shown in FIG. 8. It is composed of two longitudinal spars 106 and 107, which are connected to each other by a head cross brace 108. In addition, the two longitudinal spars 106 and 107 are connected to each other at the height of the longitudinal spars 18, 19 of the central section 13 of the reclining frame by means of in this case four braces 109, 110, 111, and 112. This configuration produces a kind of open box profile, which is oriented to receive forces originating from extension arms 113, 114, 115, and 116 without torsion and expansion of the distance between the longitudinal spars 106 and 107 in the region of the braces 109-112 when the reclining frame 11 is loaded with a patient. In this instance the two bottom braces 109 and 112 act as compression braces, which is why, as can be seen in FIG. 9, they comprise a quadrilateral tube. The top braces 111 and 110 are loaded only under tension, which is why it is sufficient to use a flat profile here, as also shown in FIG. 9.

The extension arms 113-116 are welded onto the outer side of the two longitudinal spars 116 and 107 projecting outward as shown, such that the two extension arms 113, 115 are flush with each other just like the two extension arms 114 and 116. The longitudinal axes of these pairs of extension arms 113 . . . 116 are parallel to each other. Their length equals approximately 20 cm, and they carry the spars 18 and 19, which are set rigidly and immovable on the free projecting ends, with an intermediate positioning of a spacing piece 117. In this regard, the extension arms 113 . . . 116 form the mechanically fixed connection between the reclining frame 11 and the intermediate frame 10.

For driving the upper leg section 15 and also the lower leg section 16, a shaft 118 is supported between the two longitudinal spars 106 and 107. Rigid, parallel arms 119 and 120, which are connected to each other at their free end by a cylindrical brace 121, are fixed to this shaft 118. The brace 121 projects past the arms 120 and 119. The projecting ends act as bearing pegs for two cylindrical rollers 122, of which only one is shown in the drawings. The two rollers 122 run in the guide rails 31 and support the lower leg section 27 at the relevant position.

To turn the shaft 118 and thus to lift the lever 119, 120, another lever pair 123, which acts as a linking point for a connecting rod 131, sits on the shaft 118 in a connection without rotational play. The connecting rod 131 is connected to a lifting tube 132 of a drive motor 133. The setup of the drive motor 133 corresponds to the setup of the drive motor 57. The longitudinal axis from the formation of the connecting rod 131 and lifting tube 132 runs parallel to the longitudinal spar 106 and is adjacent to the longitudinal spar 106 at its inner side. The motor 133 is supported on a bracket 134, which is reinforced by an insert piece 135 against the longitudinal spar 106. The connection between the connecting rod 131 and the lifting tube 132 is a hinge type connection. To prevent buckling, the lifting tube 132 is guided in a special way in the area of the coupling point with the connecting rod 131.

Two short U shaped guide rails 137 and 138 are attached onto the two bottom spars 109 and 112 with the intermediate positioning of a spacing element 136. The two U shaped guide rails 137 and 138 open in the direction toward each other and lie at the same height.

A fork head 139, which grips the free end of the lifting tube 137 from the outside, is attached to the connecting rod 131. An axial bolt 140, on which two rollers 141 are rotationally supported pass through boreholes flush with each other in the fork head 139 and the end of the lifting tube 132. The rollers 141 run in the guide rails 137 and 138. Buckling of the connecting point between the fork head 139 and the lifting tube 132 is thus effectively prevented. In this way, it is possible to couple the motor 133 with the shaft 118, wherein the vertical installation space in this region is limited to approximately 5 cm.

The attachment of the intermediate frame 10 to the swiveling bolster 64 is achieved with the aid of two angular flanges 143, of which only one can be seen in FIG. 8. The angular flanges 142 are welded onto the outer side of the longitudinal spars 106 and 107, while its other leg 143 is flush with the bottom side of the relevant longitudinal spar 106, 107. In the legs 143, there is a total of four longitudinal holes 144, which are flush with longitudinal holes 145 in the legs 96 of the swiveling bolster 64. The longitudinal holes 145 are directed outward, i.e., their longitudinal axis is vertical to the adjacent longitudinal spar 68, 69, while the longitudinal holes 144 lie parallel to the longitudinal spar pair 106, 107. In this way, the intermediate frame 10 can be adjusted to the swiveling bolster 64 in the longitudinal direction of the bed. Simultaneously, in each possible adjustment position of the two longitudinal spars 68 and 69 of the swiveling bolster 64 relative to each other, an attachment of the intermediate frame 10 is possible.

Finally, a motor counter-support 146, which is attached to a column 147 projecting downward, is present on the two cross braces 109 and 110. The column 147 is attached to a flat side on the two braces 109 and 110. It projects in the assembled state into the space of the swiveling bolster 64, which is defined by the longitudinal braces 68 and 69 and also the connecting braces 71-74. This space also holds the parts of the drive motor 133 projecting downward. Apart from this fact, the vertical extent of the intermediate frame 10 is limited to approximately 5 cm plus the cover of the braces 110 and 111. These have a material thickness of approximately 5 mm.

The assembly of the rotary hinge 9 is as follows: after the base 8 is completely assembled with the inserted ring 48, the bearing blocks 86-89 are equipped with the guide rollers 85. The screw 91 in the longitudinal hole 42 is set to the smallest radial distance. In addition, the support rollers 84 are set on the axial pegs 79-83. Then each longitudinal spar 68, 69 is inserted individually into the interior, as defined by the ring 48. For this purpose, the support rollers 84 connected to the longitudinal spar 68 and also the associated guide rollers 84 are threaded in the gap between the two legs 65 and 66. When the first longitudinal spar 68 is inserted with its accessories accordingly, the same process is repeated with the other longitudinal spar 69.

As soon as both longitudinal spars 68, 69 are inserted, the screws 75-78 are inserted through the associated openings, which protects the connecting braces 71-74 against downward buckling. Then the two longitudinal spars 68, 69 are pressed so far outward in the radial direction until the guide rollers 85 attached directly to these spars fit in the ring 48 with minimal play, i.e., only a small amount of radial air still shows relative to the back 67 of the ring 48. In this position of the longitudinal spars 68, 69 relative to each other, the screws 75-78 are tightened. The two diametrically opposed guide rollers 85 in the bearing blocks 86 and 88 now have a separation from each other that corresponds approximately to the diameter of the ring 48 in the region of the inner side 67. In this position, the guide roller 85 also contacts the back 76 in the bearing block 87 with a small amount of play.

After the bolster 64 has been adjusted in this way, the screw 91 in the longitudinal hole 92 is adjusted until the associated guide roller 85 also shows a small distance to the back 67. The swiveling bolster 64 is assembled in this way within this ring 48 and adjusted with reference to the radial air. It has a small amount of radial air in the guide ring and supporting ring 48. The axial air is defined by the diameter of the support rollers 84 relative to the distance of the leg 65 and 66. These rollers are cylindrical rollers and comprise, e.g., low friction PTFE, which exhibits sufficient load capacity for rollers of this type.

The height of the ring 48 measured over the outer side of the two legs 65 and 66 equals approximately 30 mm. The top side of the profile leg 96, which points upward in the normal position of use of the bed 1, projects approximately 5 mm over the top side of the top leg 66 of the ring 48. The rest of the swiveling bolster 64 disappears in and under the ring 48. The rotary hinge 9 thus projects only by the gap required for moving the intermediate frame 10 over the top side of the ring 48 and thus also correspondingly over the top side of the top frame 34.

As soon as the assembly is completed, the intermediate frame 10 is attached to the swiveling bolster 64, wherein the flanges 143 are placed on the flanges 96. Here, the shaft 118 lies in the direction toward the foot end of the bed 1. The intermediate frame 10 is tightened on the swiveling bolster 64 with the aid of 4 screws, which are not shown in the drawings for reasons of clarity. The screws are led through the openings 144, 145, which are flush with each other in pairs.

After assembly, there is a gap of approximately 10 mm, which overall produces a very low structural height, between the top side of the top frame 34 and the bottom side of the intermediate frame 10, formed by the bottom side of the longitudinal spars 107. The two bottom connecting spars 109 and 112 do not project downward over this bottom side of the intermediate frame 10.

The motor 97 can be mounted by the openings in the intermediate frame 10, which are defined in the longitudinal direction by the braces 109 and 110 or 108. According to whether rotation to the right or to the left is desired, the lifting tube 103 is connected to the motor counter-support 98 or to the motor counter-support 99. These two motor counter-supports 98, 99 have the same radial distance of approximately 10 cm from the vertical rotational axis, which is represented in FIG. 6 by a cross 148. Because the other motor counter-support lies at the foot end, moving into the lifting tube 103 causes rotation to the right in the intermediate frame 10 when the lifting tube 103 is attached to the motor counter-support 98. In contrast, rotation to the left is effected when the lifting tube 103 is anchored to the motor counter-support 99.

After the bed 1 has been assembled this far, the longitudinal spars 25 of the upper leg section 15 connected to each other by the braces 26 are hinged to the foot ends of the two longitudinal spars 18 and 19. In turn, the longitudinal spars 27 of the lower leg section 16 are attached to this section. Then, the rollers 122 are threaded into the guide rail 31 by lifting the upper leg and the lower leg section 15, 16.

Then the motor 133, which is coupled to the connecting rod 131 via the fork head 139, and the shaft 118 are mounted in the top frame. For the assembly, the two guide rollers 141 are threaded into the associated guide rails 137 and 138.

Similar to how the upper leg section 15 was mounted previously, now the back section 14 is also attached to the central section 13. An associated drive motor 149 is attached to the motor counter-support 146 and connected to its lifting tube 151 with a coupling bracket 152, which sits on the brace 24. The brace 24 is positioned so that it contacts the longitudinal spars 106 and 107 for a horizontally aligned back section 14 and the motor counter-support bracket 152 is located within the opening of the intermediate frame 10, which is bounded at the head end by the cross brace 108. Here, parts of the motor 149 project into the swiveling bolster 64.

In the explanation below of the function of the nursing bed 1, first the reclining position from FIG. 1 will be discussed. In this position, the base 1 is compacted to its maximum extent, i.e., the lifting tube 61 is pulled back into the guide tube 62. The toggle lever pairs 36, 37 are folded together to the maximum extent. The intermediate frame 10 lies in the longitudinal direction of the bed 1. The back section 14 is lowered and contacts the longitudinal spars 106, 107 of the intermediate frame 10 with its cross brace 34. Through corresponding activation of the drive motor 133, the levers 119, 120 are brought into a position in which the lower leg section 16 runs in a straight extension of the back section 14 or the foot section 17. In this position, the upper leg section 15, which is not driven, also contacts the two longitudinal spars 106 and 107 with its brace 26. In this position, the nursing bed 1 has no pinching points accessible from the outside. The contact points on the intermediate frame 10 are displaced by approximately 20 cm inward relative to the outer edge of the mattress 12, and thus are not accessible.

The patient can align the back section 14 as desired. For this purpose, he actuates the drive motor 149 by means of a hand control. Its lifting tube 151 is extended and presses the back section 14 upward. The resulting flow of forces is closed by means of the braces 110 and 109 of the intermediate frame 10. If necessary, for additional support, the swiveling bolster 64 can also be pulled out, when the column 147 is brought into contact against the brace 71 during assembly. In this way, another support of the column 147 is achieved, so that a load on the order of 80 kg can be lifted to the top cross brace 23 of the back section 14.

The lifting of the lower leg section 16 is effected by the user actuating the motor 133. The lifting tube 132 is extended and pushes the connecting rod 131 in the direction toward the shaft 118. This shaft is turned in order to pivot the levers 119, 120 upward and to press the lower leg part 16 upward. Through suitable contacts in the guides 31, simultaneously the lower leg section 16 is pulled toward the central section 13 when the levers 119, 120 pivot upward. As a result, the upper leg section 15 is also set as shown at an upward angle.

When the patient would like the nursing bed 1 to bring him into a position similar to that of a healthy person sitting on the edge of the bed, he first brings the lower leg and the upper leg sections 15, 16 into the position shown in FIG. 3. In addition, the back section 14 is brought into a position of approximately 45°, so that for subsequent rotation, there is no excess loading past the outline of the bed. As soon as the reclining frame 11 is set accordingly, the base 8 moves upward until the bottom side of the intermediate frame 10 can turn freely over the upper edge of the two side walls 5, 6.

When this position is reached, the lifting motor 57 is stopped and the rotary motor 97 associated with the rotary hinge 9 is actuated. Its lifting motor 103 starts and turns the intermediate frame 10 together with the reclining frame 11 located on the intermediate frame by 90° either to the left or to the right according to which counter-support 98, 99 the rotary motor 97 is linked. As soon as the rotary end position is reached, the lifting motor 57 is set in gear again in order to compact the base 8 into its smallest position. For the downward movement, the bottom side of the intermediate frame 10 engages with the top side of the side wall 5 and presses it downward.

After reaching the lowest position, the motor 133 is actuated, such that the lifting tube 132 is pushed into the associated guide tube. This movement pulls the connecting rod 133 back, wherein the levers 119, 120 are pivoted downward. This downward pivoting of the levers 119, 120 has the effect of also pivoting the foot section downward until it reaches the end position shown in FIG. 2. Finally, the patient can still position the back section 14 even more upright if desired. A more upright position during the rotating process is generally considered uncomfortable with raised feet.

As follows from the description of the operation, in the sitting or seat position, the length of its lower leg section 16 measured from the top edge of the mattress 12 may not be longer than the length of the lower leg for an average sized person. Otherwise, the soles of the feet could not reach the floor. In the novel bed, because the bed 8 can be compacted so that it is very small, and also because the structural height of the components comprising the rotary hinge 9, the intermediate frame 10, and the reclining frame 11 is extremely small, there are still ca. 12 cm in the chair position by which the bottom frame 35 can be raised.

Thus, in the bed position shown in FIG. 1, there remains sufficient space not only under the side wall 5, but also under the base 8, so that care personnel can step sufficiently close to the bed 1. As mentioned, the proportioning of the upper leg section 15 and the lower leg section 16 must be oriented to the human anatomy. For the normal reclining position, the lower leg section 16 would be too short, which is why there is the foot section 17, which carries a separate mattress section.

With the aid of the nursing bed 1, patients can be moved from the reclining position into a sitting position perpendicular to the bed without exerting any of their own strength and without relying on the help of care personnel. From this position, the patient can also be brought back into the reclining position, wherein the sequence of movements described above are performed in the reverse order.

Finally, the nursing bed 1 is also suitable as a standing aid. The patient first can be brought into a position corresponding to FIG. 2. Then the patient leans forward from the bed and simultaneously activates the height adjustment of the base 8. Therefore, the patient's buttocks are raised, so that the patient exerts less force to reach a standing position. Such an aid is very helpful for patients with multiple sclerosis or weak muscles. Patients who would otherwise have to depend on outside help to leave the bed can do this with the aid of the nursing bed 1 at their own discretion without outside help.

Figure 11:
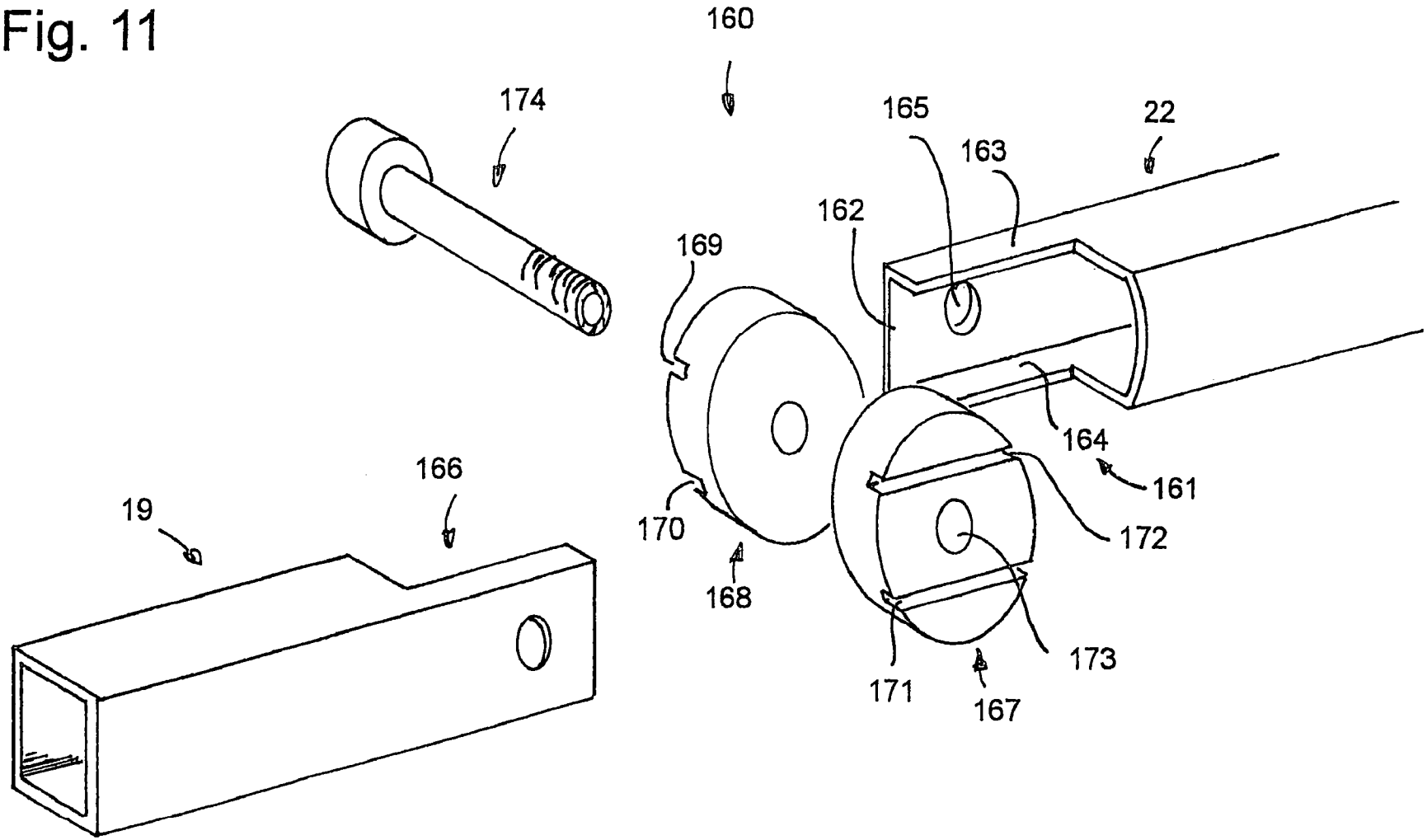
FIG. 11 is an exploded perspective view of one of the hinges of the reclining frame.

In an enlarged, exploded view, FIG. 11 shows a hinge 160, as it is used, e.g., between the longitudinal spar 19 and the longitudinal spar 22. As also shown in FIG. 11, both longitudinal spars 19, 22 consist of a quadrilateral tube with an approximately 30 mm edge length. At the end, the longitudinal spar 22 is provided with a recess 161. The recess 161 extends one piece wide in the direction of the longitudinal direction of the spar 22 and one piece wide in the cross direction. The depth of the recess 161 in the cross direction is smaller than that corresponding to the width of the longitudinal spar 22. It produces an imaginary hinge bracket 162, whose length corresponds to the depth of the recess 161 in the longitudinal direction of the spar 22. This hinge bracket 162 is formed at the edges by connecting pieces, which reinforce the remaining sections 163 and 164 of the profiled tube wall. In this way, the bracket 162 generally obtains the shape of a U profile viewed in the area of the hinge 160. In the middle of the bracket 162, there is a through-hole 165.

The adjacent end of the spar 19 is provided in the same way with a notch 166, wherein the notch 166 points toward the opposite side. A plastic disk 167 and 168 with cylindrical cross section and flat end surfaces sits in each of the recesses 161 and 166. The disk 168 is provided on only one of its end surfaces with two grooves 169 and 170, which hold the connecting pieces 163 and 164. In a corresponding way, the disk 167 has surface grooves 171, 172 in only one end for the corresponding connecting pieces of the spar 19. The diameter of the two disks 167 and 168 is dimensioned so that the brackets 162 do not project with their free ends past the outer peripheral surface of the disks 167 and 168.

The illustrated hinge 160 is assembled by placing the associated disk 168 or 167 on each bracket 162. The reinforcing connecting pieces 164 and 163 which incidentally, join integrally and continuously to the profiled tube that forms the spar 19 or 22, are held as a whole in the grooves 169, 170 or 171, 172. A cylindrical borehole 173 contained in each disk 167 and 178 is aligned with the relevant hole 165 in the bracket 162. A screw 174, which is secured on the other side with a nut (not shown), is inserted through these boreholes. The hinge 160 is biased without clearance by the screw 174.

The disks 167 and 168 act, so to speak, as sliders and fillers to fill the open space within each bracket 162 and to form a sliding surface for the other disk 167, 168. Because the diameters of the disks are also greater than the thickness of the profiled tube for the spars 19 and 22, no cutting points are produced when the hinge 160 bends, because the two disks 167 and 168 contact each other with the same diameter.

The illustrated hinge 160 is in a position to receive considerable compressive and tensile forces without additional means. Such considerable tensile forces occur, e.g., at the connection between the central part 13 and the back section 14.

Figure 12:
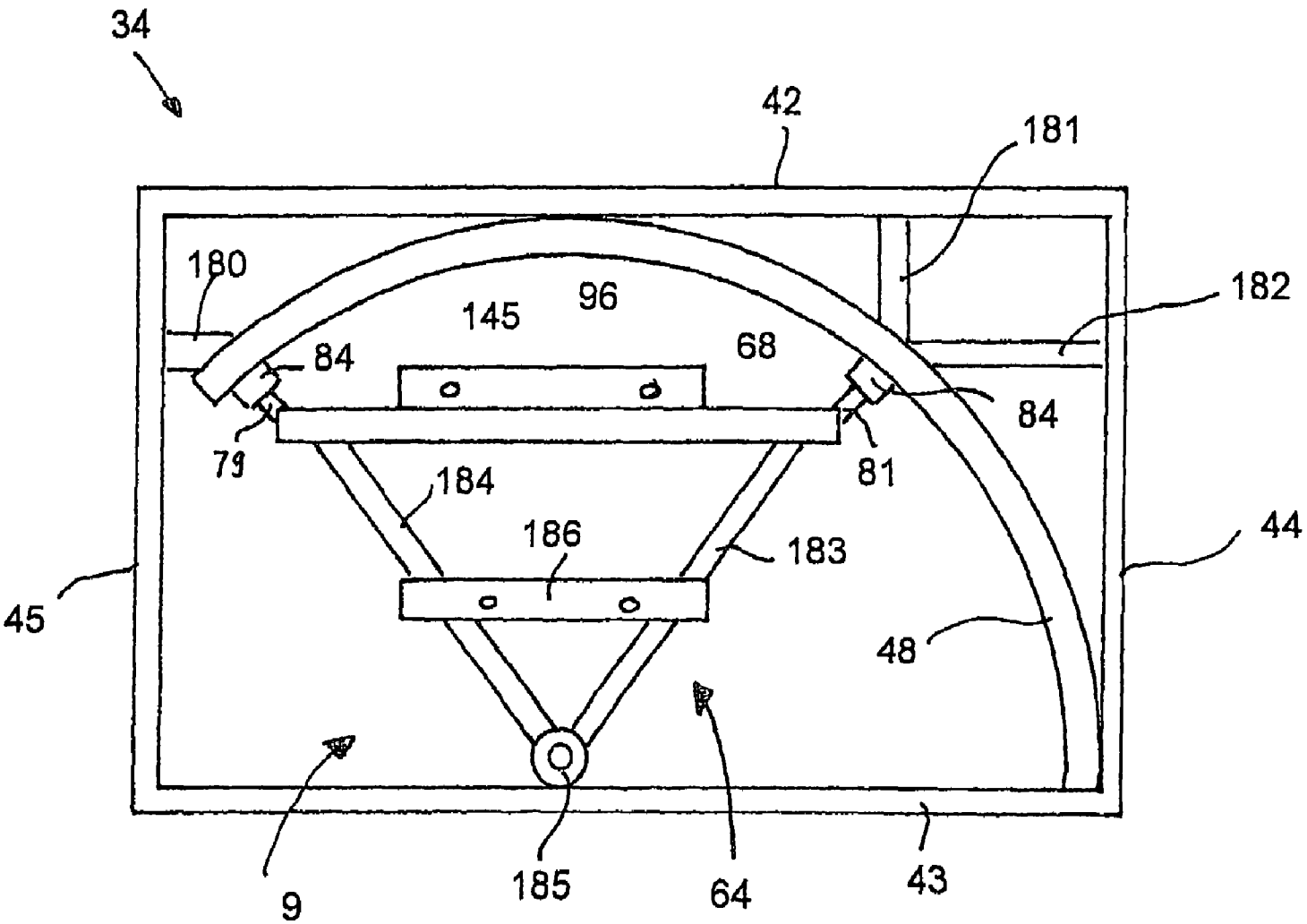
FIG. 12 is an alternative embodiment of the top frame of the rotary bed of the invention having a non-circular ring.

While a rotary hinge 9 is used in the embodiment from the preceding figures, in which the supporting ring 48 forms a complete circle, FIG. 12 shows a modification with a rotary hinge 9, whose supporting ring has a radius that essentially corresponds to the open width between the two longitudinal spars 42 and 43. Already explained components are provided with the same reference symbols in the embodiment of FIG. 12 and are not explained again.

In a top view, FIG. 12 shows the top frame 34 with the two longitudinal spars 42 and 43, which are connected at both ends by means of the cross braces 44 and 45. The cross brace 46 is eliminated. The rotary hinge 9 has a supporting ring 48, which begins at the inner corner between the longitudinal spar 43 and the cross brace 44. The supporting ring 48 runs from there in a circular arc to the inner side of the longitudinal spar 42, and extends further by approximately 45° past the contact point with the longitudinal spar 42. Thus, the supporting ring 48 overall has a length corresponding to a centering angle of approximately 135°.

The supporting ring 48 is connected in the area of the inner corners between the cross brace 44 and the longitudinal spar 43 at the inner side of the longitudinal spar 42, as well as by means of other braces 180, 181, and 182, to the top frame 34. The swiveling bolster 64 has only one of the two longitudinal spars (e.g., the longitudinal spar 68) from which two connecting braces 183 and 184 converging in the direction toward the longitudinal spar 43 extend in the shape of a triangle. The connecting braces 183 and 184 end at a hub 185, to which they are rigidly connected.

The hub 185 can rotate on a bearing block, which is located underneath the hub and which is attached at the inner side of the longitudinal spar 43. The rotational axis of the hub 185 corresponds to the center point of the supporting ring 48.

As before, the axial pegs 79 and 81, on which the cylindrical support rollers 84 are rotatably supported on the ends of the longitudinal spar 68. As before, the support rollers 84 engage between the legs 65 and 66 of the supporting ring 48, which also has the cross sectional profile according to "A" from FIG. 5.

On the outer side of the longitudinal spar 68, the attachment flange 96 is provided with the attachment boreholes 145. Another attachment flange 186 is attached to the top side, which is facing the viewer, of the two triangular connecting braces 183 and 184. The attachment flange 184 lies in the same plane as the attachment flange 96 relative to the plane as defined by the supporting ring 48. As before, the intermediate frame 10 is mounted on the two attachment flanges 96 and 186.

When the intermediate frame 10 is attached to the top frame of FIG. 12, the intermediate frame turns about an axis, which is directly adjacent to one of the two longitudinal spars. The advantage of this arrangement is that the reclining frame turns about a point that is very closely adjacent to the outer edge of the bed 1. This configuration prevents the inside edge of the reclining frame 11 from moving too much in the direction of the head end of the bed during turning. In this case, it must be taken into account that the construction can be changed from a left turning variant into a right turning variant without any additional components, as can be achieved in the example above by changing the rotary motor 97. Another advantage of the arrangement from FIG. 12 is that beds can also be realized, in which the width of the bed exceeds the commercially available 90 cm width.

A nursing bed is provided that has a height adjustable base, in which a rotary hinge is attached in a substantially countersunk arrangement. The rotary hinge connects the base to an intermediate frame on which the actual reclining frame is installed. In this way, a bed framework is obtained, which, after subtracting the height of support feet, has a very small structural height, so that in the lowest position, the top edge of the mattress from the floor corresponds to the length of the lower leg, while simultaneously there is still space underneath the base.

The invention claimed is:

1. A rotary bed comprising:

a base settable on a floor, the base including a head at a distance from the floor and whose distance from the floor is adjustable;

a reclining frame sized for receiving a mattress;

a rotary hinge arranged at the head of the base for connecting the reclining frame to the base and for permitting rotation of the reclining frame relative to a vertical axis;

wherein the rotary hinge includes a circular, annular supporting ring that is closed in the circumferential direction, a swiveling bolster that supports the reclining frame being pivotably supported in the supporting ring, the swiveling bolster being connected to the base via only the supporting ring and without any axial pegs.

2. The rotary bed according to claim 1, wherein the swiveling bolster has two longitudinal spars that are connected to each other via a pair of separated cross braces located within the supporting ring.

3. The rotary bed according to claim 2, wherein each cross brace is formed from two interconnected braces, each of which is rigidly and undetachably connected to an associated one of the longitudinal spars.

4. The rotary bed according to claim 3, wherein the two cross braces are screwed together.

5. The rotary bed according to claim 2, wherein the distance between the longitudinal spars is adjustable.

6. The rotary bed according to claim 2, wherein the longitudinal spars have bearing elements at their ends that interact with the supporting ring.

7. The rotary bed according to claim 6, wherein each bearing element includes at least one axle that is connected to the respective longitudinal spar and a roller that can turn on the axle and wherein the axles are aligned with the supporting ring in the radial direction.

8. The rotary bed according to claim 6, wherein the bearing means elements are arranged relative at corners of a quadrilateral.

9. The rotary bed according to claim 2, wherein the supporting ring has a groove that is open on an inside and is continuous.

10. A rotary bed comprising:

a base settable on a floor, the base including a head spaced a distance from the floor and whose distance from the floor is adjustable;

a reclining frame sized for receiving a mattress;

a rotary hinge arranged at the head of the base for connecting the reclining frame to the base and for permitting rotation of the reclining frame relative to a vertical axis;

wherein the rotary hinge has a circular arc shaped, curved supporting ring for supporting a swiveling bolster for rotation about a rotational axis that is offset laterally relative to a longitudinal axis of the base.

11. The rotary bed according to claim 10, wherein the swiveling bolster is connected to the reclining frame.

12. The rotary bed according to claim 10, wherein the supporting ring has a radius of curvature that is greater than half a width of the reclining frame.

13. The rotary bed according to claim 10, wherein the rotary hinge includes a pair of axle elements that interact with a positive fit, each of the axle elements including a rotational axis that coincides with a geometric axis of the supporting ring.

14. The rotary bed according to claim 10, wherein one of the axle elements is provided on the swiveling bolster and the other axle element is provided on the base.

15. The rotary bed according to claim 10, wherein the supporting ring includes a groove that is open on an inside and in which the swiveling bolster is guided.

16. The rotary bed according to claim 10, wherein the swiveling bolster includes at least one bearing element that interacts with the supporting ring at a radial distance from an axle element.

17. The rotary bed according to claim 10, wherein the swiveling bolster includes at least two separate bearing elements that interact with the supporting ring at a radial distance from an axle element.

18. The rotary bed according to claim 10, wherein the supporting ring extends over a circumferential angle of 90° or greater.

19. A rotary bed comprising:

a base settable on a floor, the base including a head spaced a distance from the floor and whose distance from the floor is adjustable;

a rotary hinge arranged at the head of the base, the rotary hinge having a rotational axis that is aligned vertically, an intermediate frame including two parallel intermediate frame spars that are attached to the rotary hinge; and a reclining frame sized for receiving a mattress, the reclining frame having a width that is greater than a distance between the intermediate frame spars, the reclining frame being divided into a central section, a back section, and a foot section, wherein each section of the reclining frame is bound laterally by two associated longitudinal spars that extend parallel to each other, and the longitudinal spars of the central section are connected exclusively to the intermediate frame wherein each intermediate frame spar has at least one laterally projecting extension arm for attaching to the corresponding longitudinal spar and the intermediate frame spars are connected to each other by at least two braces at a height of the extension arms and the at least two braces lie in two parallel planes that are separated in the vertical direction relative to a position of use of the bed.

20. The rotary bed according to claim 19, wherein each of the intermediate frame spars has a tubular profile.

21. The rotary bed according to claim 19, wherein the two braces are offset relative to each other in a longitudinal direction of the intermediate frame spars.

22. The rotary bed according to claim 19, wherein at least two braces are in a top plane and at least two braces in a bottom plane.

23. The rotary bed according to claim 19, wherein a distance between the braces and the intermediate frame spars at least approximately corresponds to a vertical height of the intermediate frame spars.

24. The rotary bed according to claim 19, wherein a shaft is rotatably supported between the intermediate frame spars, the shaft having a rotational axis that extends at a right angle relative to a longitudinal extent of the intermediate frame spars, a first lever being rigidly attached to the shaft and wherein the first lever is actively connected with the foot section, a second lever being coupled to a drive device.

25. The rotary bed according to claim 24, wherein the drive device has a screw spindle drive, a spindle of the drive device extending in a direction parallel to the longitudinal extent of the intermediate frame spars.

26. The rotary bed according to claim 25, wherein a longitudinal guide is attached in the intermediate frame, a guide sled being guided in the longitudinal guide, the guide sled acting as a kinematic connecting point between the drive device and a connecting rod that couples the guide sled to the second lever.

27. The rotary bed according to claim 24, wherein two separated and parallel first levers are attached to the shaft.

28. The rotary bed according to claim 27, wherein the two first levers have free ends that are set at a distance from the shaft and to which carrier pegs are attached, each carrier peg running in a guide rail connected to the foot section.

29. The rotary bed according to claim 28, wherein the two guide rails extend parallel to each other.

30. The rotary bed according to claim 29, wherein the two guide rails extend in a plane that encloses an acute angle with a plane defined by the foot section, the acute angle opening in a direction toward the head end of the bed.

31. The rotary bed according to claim 19, wherein the back section is supported so that it can pivot relative to the central section about an axis that extends at a right angle to the intermediate frame spats.

32. The rotary bed according to claim 31, wherein the intermediate frame has a counter-support for an adjustment drive of the back section, an attachment point of the counter-support lying underneath the axis about which the back section can pivot relative to the central section.

33. The rotary bed according to claim 32, wherein the back section has a counter-support for the adjustment drive, an attachment point to the counter-support of the back section lying higher than the attachment point to the counter-support that is attached to the intermediate frame (10).

34. A rotary bed comprising:

a base settable on a floor, the base including a head at a distance from the floor and whose distance from the floor is adjustable;

a rotary hinge arranged at the head of the base, the rotary hinge having a rotational axis that is aligned vertically;

a reclining frame sized for receiving a mattress and divided into a central section, a back section, and a foot section;

an intermediate frame for connecting the reclining frame to the rotary hinge, the intermediate frame including two parallel intermediate frame spars attached to the rotary hinge, and a sled guide arrangement arranged between the intermediate frame spars, a sled being guided in the sled guide arrangement, a drive device and a connecting rod being attached to the sled, the sled being kinematically coupled to the foot section of the reclining frame.

35. A rotary bed according to claim 34, wherein a shaft is rotatably supported between the intermediate frame spars, that shaft having a rotational axis that extends at a right angle to a longitudinal extent of the intermediate frame spars, a first lever being rigidly attached to the shaft, the first lever being actively connected to the foot section, a second lever being coupled to the drive device.

36. A rotary bed according to claim 35, wherein the drive device has a screw spindle drive that includes a spindle that extends in a direction parallel to the longitudinal extent of the intermediate frame spars.

37. A rotary bed according to claim 36, wherein a longitudinal guide is attached in the intermediate frame, a guide sled being guided in the intermediate frame, the guide sled acting as a kinematic connecting point between the drive device and a connecting rod that connects the sled to the second lever.

38. A rotary bed according to claim 35, wherein two separated and parallel first levers are attached to the shaft.

39. A rotary bed according to claim 34, wherein the first levers have free ends that are set at a distance from the shaft and to which carrier pegs are attached, each carder peg running in a guide rail that is connected to the foot section.

40. A rotary bed according to claim 39, wherein the two guide rails extend parallel to each other.

41. A rotary bed according to claim 40, wherein the two guide rails extend in a plane that encloses an acute angle with a plane defined by the foot section, the acute angle opening in a direction toward the head end of the bed.

42. A rotary bed according to claim 34, wherein the back section is supported so that it can pivot relative to the central section about an axis that extends at a right angle to the intermediate frame spars.

43. A rotary bed according to claim 42, wherein the intermediate frame has a counter-support for an adjustment drive of the back section, an attachment point of the counter-support lying underneath the axis about which the back section can pivot relative to the central section.

44. A rotary bed according to claim 43, wherein the back section is provided with a counter-support for the adjustment drive, an attachment point to the counter-support of the back section lying higher than the attachment point to the counter-support that is attached to the intermediate frame.

45. A bed comprising;

a reclining frame that is divided into a central section, a back section, and a foot section, wherein each section includes two parallel longitudinal spars; and a hinge connecting two abutting longitudinal spars of adjacent sections to each other, each longitudinal spar being formed by a quadrilateral tube that transitions integrally into a hinge bracket wherein at least one circular disk shaped spacing element is arranged between the hinge brackets.

46. A rotary bed according to claim 45, wherein two spacing elements are present, each of which is connected without rotational play to the associated hinge bracket.

47. A rotary bed according to claim 45, wherein the hinge bracket has a U shaped cross sectional profile producing two parallel bars, the profiles of two hinge brackets forming a hinge being arranged such that the U profiles open toward each other.

48. A rotary bed according to claim 45, wherein the hinge bracket transitions smoothly into a profile of the relevant longitudinal spar.

49. A rotary bed according to claim 45, wherein the longitudinal spar is formed by a quadrilateral tube, the hinge bracket being formed by a part of an end recess of the longitudinal spar.

* * * * *